US010233669B2

(12) United States Patent
Huang et al.

(10) Patent No.: US 10,233,669 B2
(45) Date of Patent: Mar. 19, 2019

(54) DOUBLE-DOOR LOCK ASSEMBLY

(71) Applicant: TAIWAN FU HSING INDUSTRIAL CO., LTD., Kaohsiung (TW)

(72) Inventors: Chao-Ming Huang, Kaohsung (TW); Yu-Cheng Lin, Tainan (TW)

(73) Assignee: TAIWAN FU HSING INDUSTRIAL CO., LTD., Kaohsiung (TW)

( * ) Notice: Subject to any disclaimer, the term of this patent is extended or adjusted under 35 U.S.C. 154(b) by 0 days.

(21) Appl. No.: 15/653,680

(22) Filed: Jul. 19, 2017

(65) Prior Publication Data

US 2018/0328077 A1 Nov. 15, 2018

(30) Foreign Application Priority Data

May 9, 2017 (TW) ..... 106115225 A

(51) Int. Cl.

| | |
|---|---|
| ***E05B 37/02*** | (2006.01) |
| ***E05B 65/08*** | (2006.01) |
| ***E05B 65/00*** | (2006.01) |
| ***E05C 9/02*** | (2006.01) |
| ***E05C 9/18*** | (2006.01) |

(52) U.S. Cl.

CPC ..... *E05B 37/02* (2013.01); *E05B 65/087* (2013.01); *E05C 9/026* (2013.01); *E05C 9/1841* (2013.01); *E05B 65/00* (2013.01)

(58) Field of Classification Search

CPC ..... E05B 77/48; E05B 77/46; E05B 65/0003; E05B 37/02; E05B 65/087; E05B 65/00; E05B 63/143; E05B 63/16; E05C 9/026; E05C 9/1841; E05C 7/02; E05C 7/06; E05C 7/00; Y10S 292/21

USPC ..... 70/276, DIG. 65; 292/251.5, DIG. 21; 49/61–63, 67; 109/6, 7, 67, 68; 312/291

See application file for complete search history.

(56) References Cited

U.S. PATENT DOCUMENTS 525,906 A * 9/1894 Johnson
1,140,524 A * 5/1915 Mosler et al. ..... E05G 1/00 109/59 R
1,686,819 A * 10/1928 Kirschbaum ..... E06B 3/7009 160/96
1,920,813 A * 8/1933 Storms ..... E05C 7/02 232/41 D (Continued)

FOREIGN PATENT DOCUMENTS

CN 2186781 Y 1/1995
CN 2206820 Y 9/1995

(Continued)

OTHER PUBLICATIONS

Taiwanese Office Action dated Jul. 28, 2017 for Taiwanese Patent Application No. 106115225, 4 pages.

*Primary Examiner* — Lloyd A Gall
(74) *Attorney, Agent, or Firm* — Jackson IPG PLLC; Demian K. Jackson

(57) ABSTRACT

A double-door lock assembly includes a first lock and a second lock which are respectively mounted on a first door and a second door. The double-door lock assembly utilizes a first linkage member of the first lock to connect a second linkage member of the second lock to allow the first and second locks to co-operate. Hence the first and second doors can be opened or closed simultaneously in the same direction.

20 Claims, 13 Drawing Sheets

(56) References Cited

U.S. PATENT DOCUMENTS

| | | | | | |
|---|---|---|---|---|---|
| 2,219,344 | A | * | 10/1940 | Taylor | E05D 11/105 16/324 |
| 2,537,896 | A | * | 1/1951 | Hinton | E05C 7/02 126/200 |
| 4,208,837 | A | * | 6/1980 | Black, Sr. | E05B 65/1033 292/216 |
| 4,302,907 | A | * | 12/1981 | Canals | E05C 7/02 292/150 |
| 4,408,546 | A | * | 10/1983 | Schmidt | E05B 65/0075 109/68 |
| 4,470,276 | A | * | 9/1984 | Bayless | E05C 7/02 292/37 |
| 4,660,873 | A | * | 4/1987 | Sholund | E05C 7/02 292/251 |
| 4,891,907 | A | * | 1/1990 | Rapaway | E05C 7/02 292/336.3 |
| 5,474,345 | A | * | 12/1995 | Clark | E05C 7/02 292/302 |
| 6,357,509 | B1 | * | 3/2002 | Lamazares | E05C 17/00 160/210 |
| 9,540,853 | B2 | * | 1/2017 | Pickar | E05B 83/44 |

FOREIGN PATENT DOCUMENTS

| | | | | |
|---|---|---|---|---|
| CN | 202139954 | U | | 2/2012 |
| CN | 203640569 | U | | 6/2014 |
| DE | 465865 | | * | 9/1928 |

* cited by examiner

DOUBLE-DOOR LOCK ASSEMBLY

FIELD OF THE INVENTION

This invention relates to a double-door lock assembly mounted on a first door and a second door, and more particularly relates to a double-door lock assembly which allows the first door and the second door to be opened or closed simultaneously in the same direction.

BACKGROUND OF THE INVENTION

For the purpose of burglar-proof, ventilation or natural light, a first door and a second door are mounted on a door frame, and a first lock and a second lock are respectively mounted on the first door and the second door. While intending to open the first and second doors, the first door has to be opened firstly via the first lock on the first door, and thus the second door can be opened via the second lock on the second door, but it is not convenient for use. In addition, more space is required for the first and second doors when they open in different directions.

SUMMARY

The primary object of the double-door lock assembly of the present invention is to allow a user to open or close a double-door simultaneously in the same direction for convenient use.

The double-door lock assembly of the present invention includes a first lock and a second lock which are respectively mounted on a first door and a second door. The first lock includes a first handle group, a first rotation member and at least one first linkage member. The first handle group is coupled to the first rotation member for rotating the first rotation member, and the first linkage member is disposed on and rotated with the first rotation member. The second lock includes a second handle group, a second rotation member and at least one second linkage member. The second handle group is coupled to the second rotation member for rotating the second rotation member, and the second linkage member is disposed on and rotated with the second rotation member. When the second linkage member is located at a first position, the first linkage member corresponds and connects to the second linkage member for simultaneous rotation of the first and second rotation members.

The double-door lock assembly of the present invention utilizes the first and second linkage members, which are connected with each other, to allow the first and second rotation members to rotate simultaneously, and to allow the first and second locks to operate simultaneously. Hence the user can simultaneously open or close the first and second doors in the same direction by only pushing the first or second handle group.

DETAILED DESCRIPTION OF THE INVENTION

Figure 1:
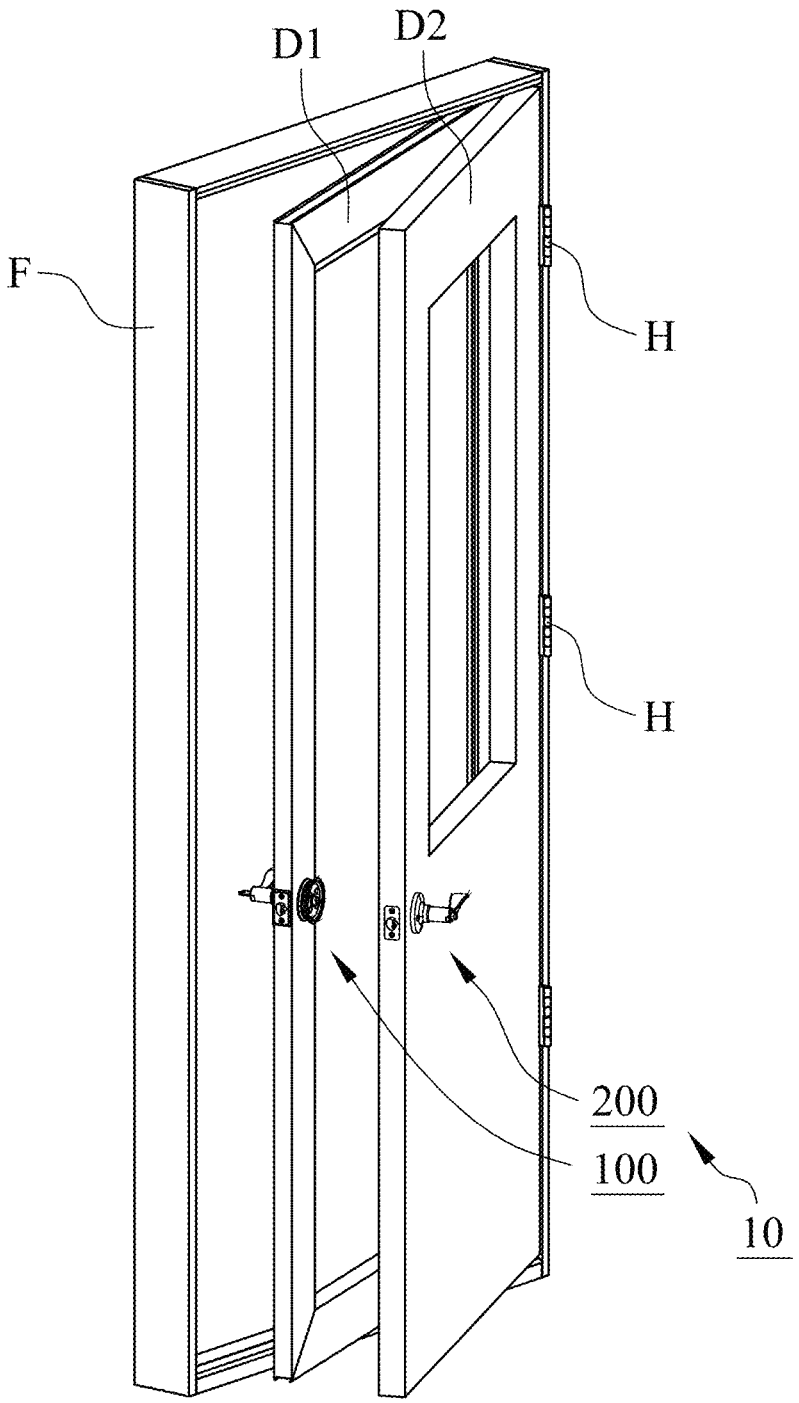
FIG. 1 is a perspective assembly diagram illustrating a double-door lock assembly mounted on a first door and a second door in accordance with one embodiment of the present invention.
Figure 2:
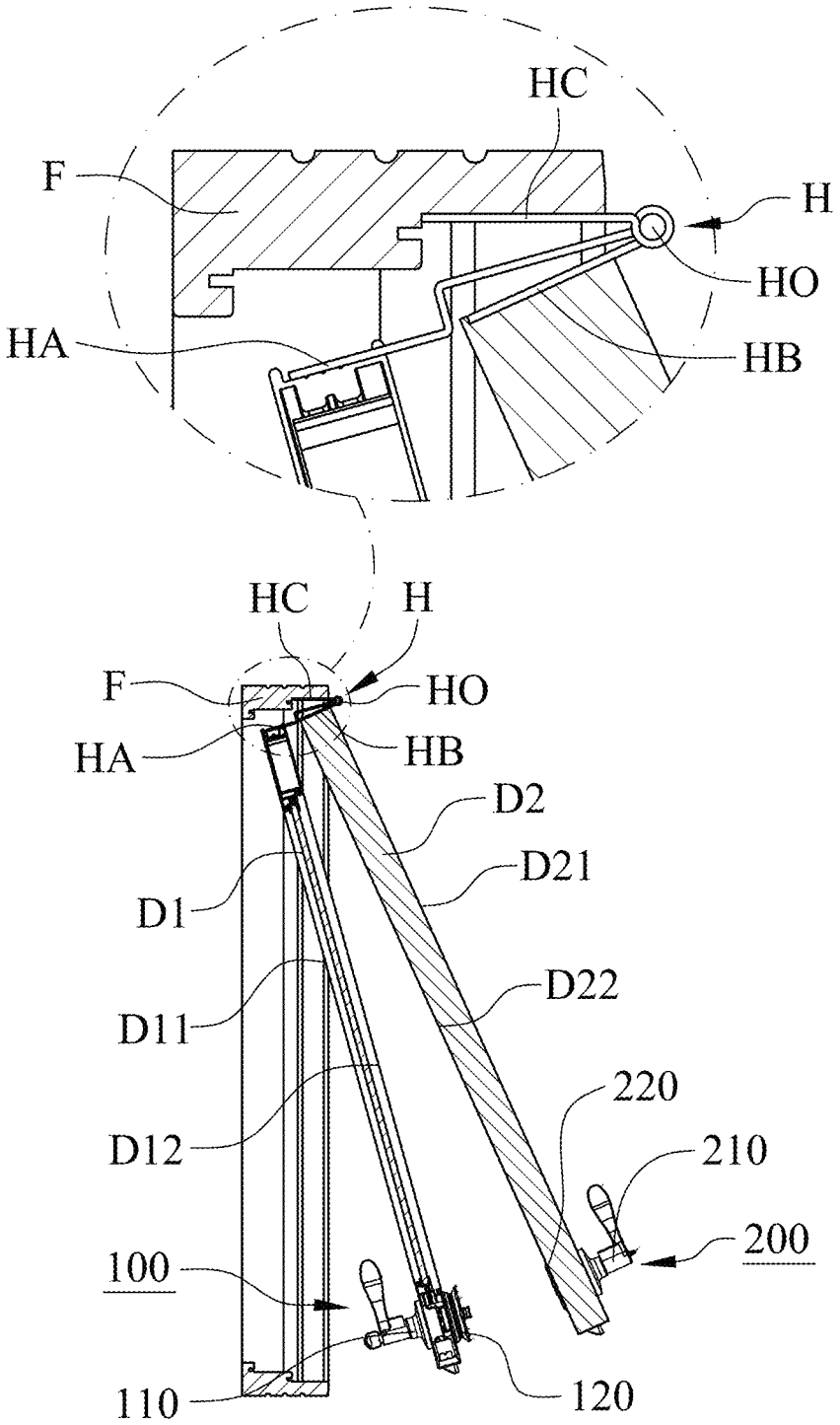
FIG. 2 is a cross-section view diagram illustrating the double-door lock assembly mounted on the first and second doors in accordance with one embodiment of the present invention.
Figure 3:
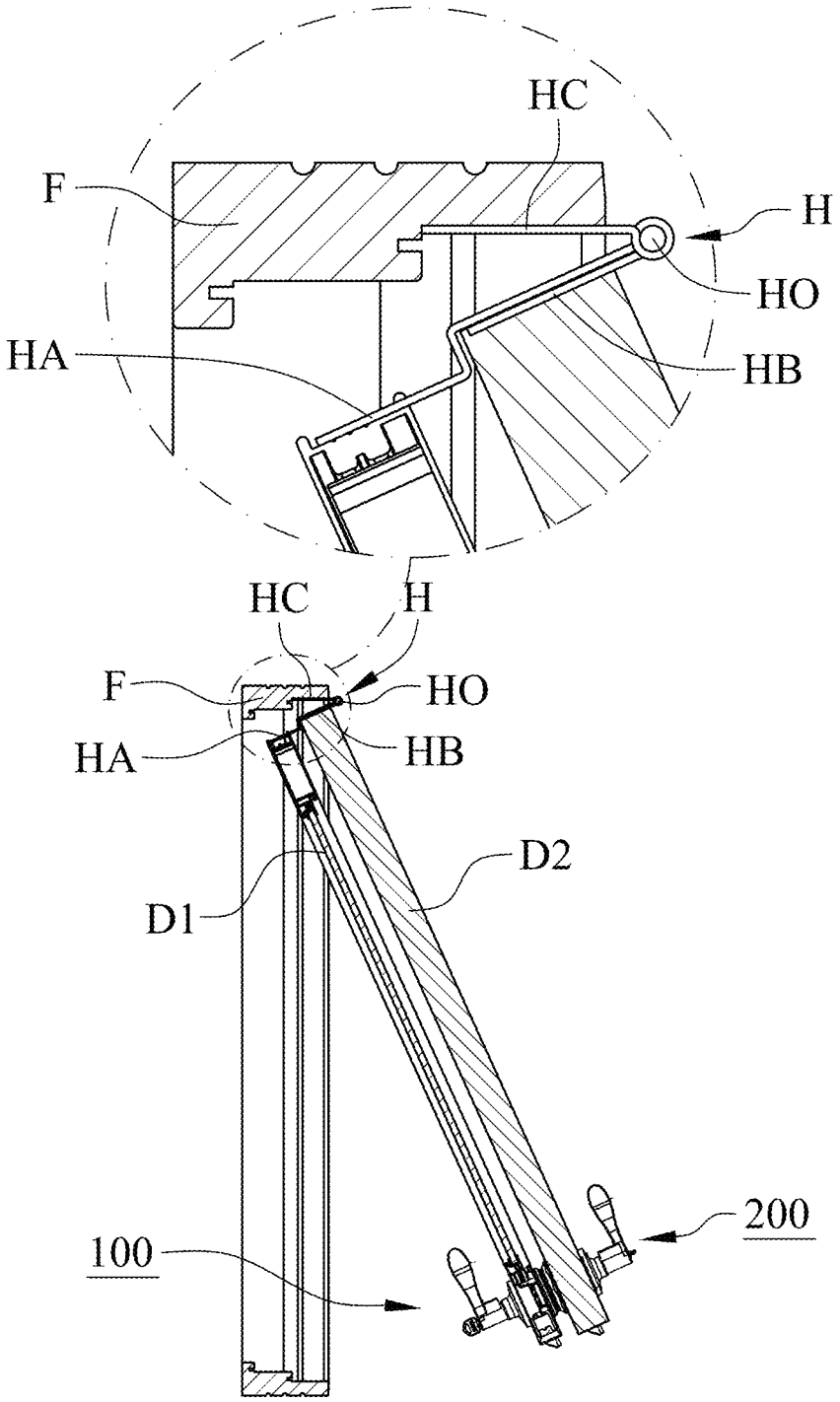
FIG. 3 is a cross-section view diagram illustrating the double-door lock assembly mounted on the first and second doors in accordance with one embodiment of the present invention.

With reference to FIGS. 1, 2 and 3, in one embodiment of the present invention, a first door D1 and a second door D2 are mounted on a door frame F via at least one hinge H. The hinge H includes a hinge axle HO and three fixing plates HA, HB and HC which are respectively fixed on the first door D1, the second door D2 and the door frame F. Each of the fixing plates HA, HB and HC pivots on the hinge axle HO to allow the first door D1 and the second door D2 pivot around the hinge axle HO for opening or closing, thus the first door D1 and the second door D2 can be opened and closed selectively. A double-door lock assembly 10 of the present invention is mounted on the first door D1 and the second door D2, and includes a first lock 100 and a second lock 200 which are respectively mounted on the first door D1 and the second door D2. With reference to FIGS. 3, 4, 5 and 6, the first door D1 and the second door D2 can be opened or closed simultaneously in the same direction by the connection of the first lock 100 to the second lock 200.

With reference to FIGS. 2, 4, 6, 7 and 8, the first lock 100 includes a first latch A, a first handle group 110, a first rotation member 120 and at least one first linkage member 130, wherein the first latch A can be locked or unlocked by a first handle H1 of the first handle group 110. In this embodiment, the first lock 100 includes a plurality of first linkage members 130.

With reference to FIGS. 2, 4, 6, 7 and 8, the first handle group 110 is installed on one side surface D11 of the first door D1, and the first rotation member 120 is rotatable installed on other side surface D12 of the first door D1. The first handle group 110 is linked to the first rotation member 120 for rotating the first rotation member 120. With reference to FIGS. 4, 7, 8, and 10, the first linkage members 130 are arranged on the first rotation member 120, and enable rotate with the first rotation member 120 when the first rotation member 120 is rotating.

With reference to FIGS. 2, 5, 6 and 9, the second lock 200 includes a second latch B, a second handle group 210, a second rotation member 220 and at least one second linkage member 230. The second latch B is driven by a second handle H2 of the second handle group 210 to be locked or unlocked.

Figure 5:
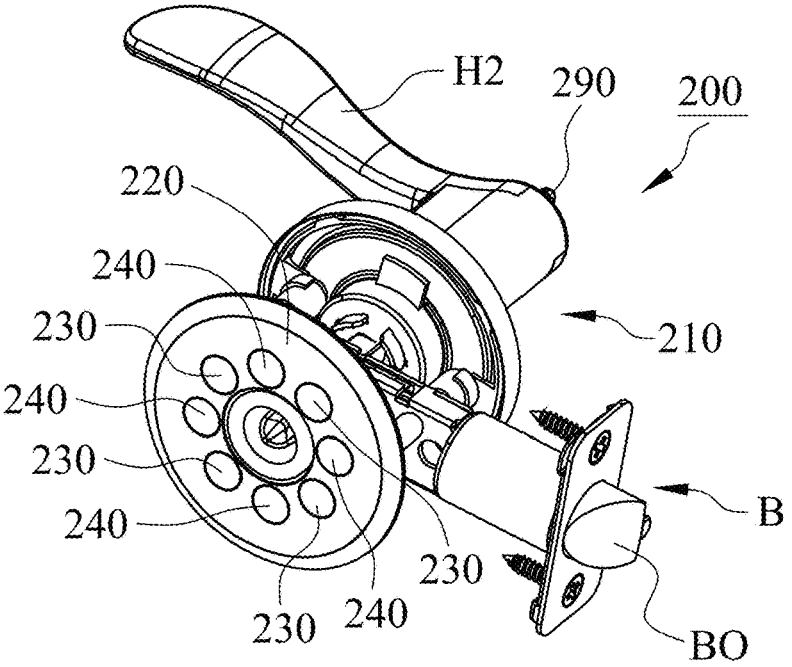
FIG. 5 is a perspective assembly diagram illustrating a second lock in accordance with one embodiment of the present invention.
Figure 9:
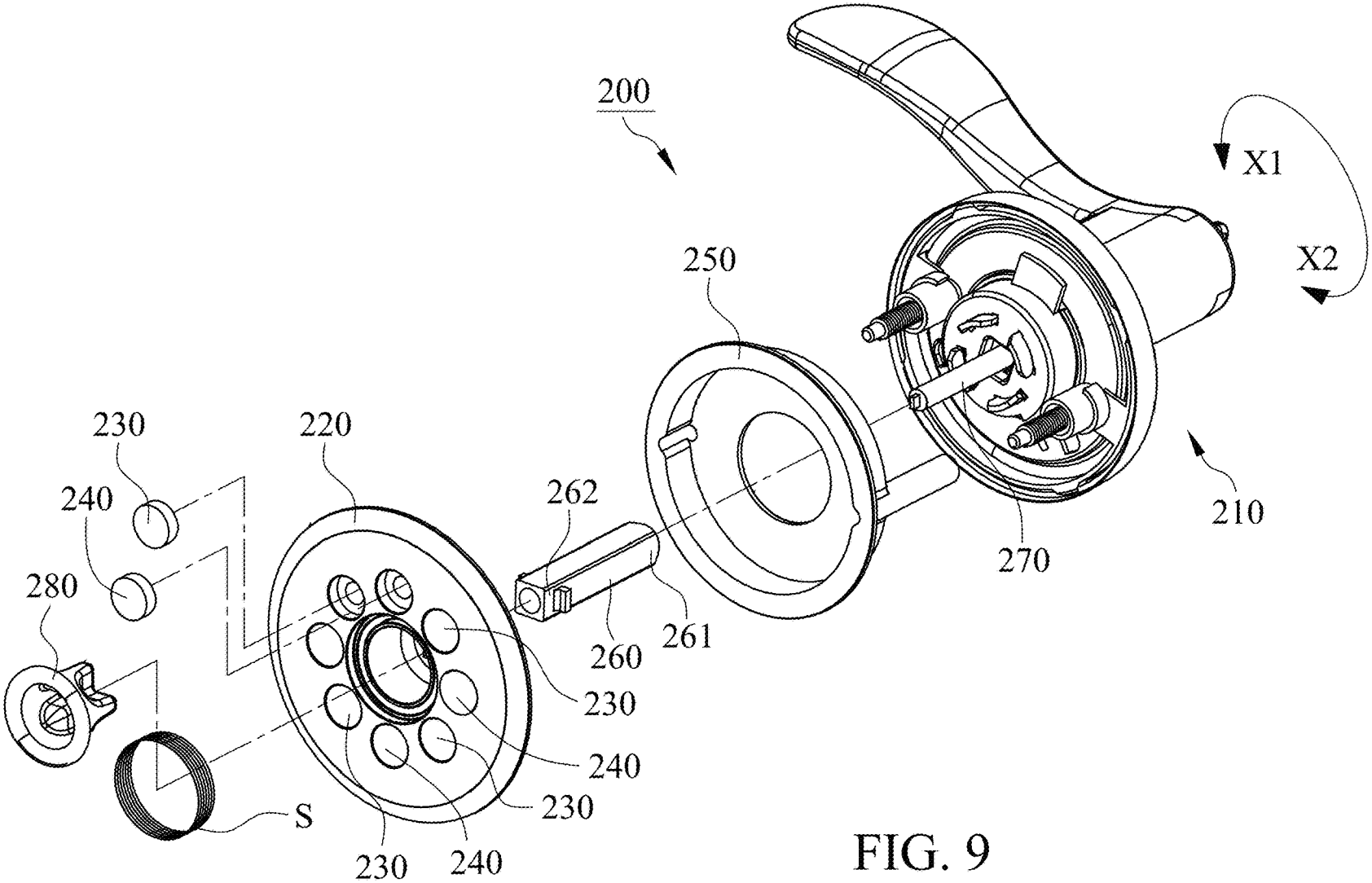
FIG. 9 is a perspective exploded diagram illustrating the second lock in accordance with one embodiment of the present invention.
Figure 10:
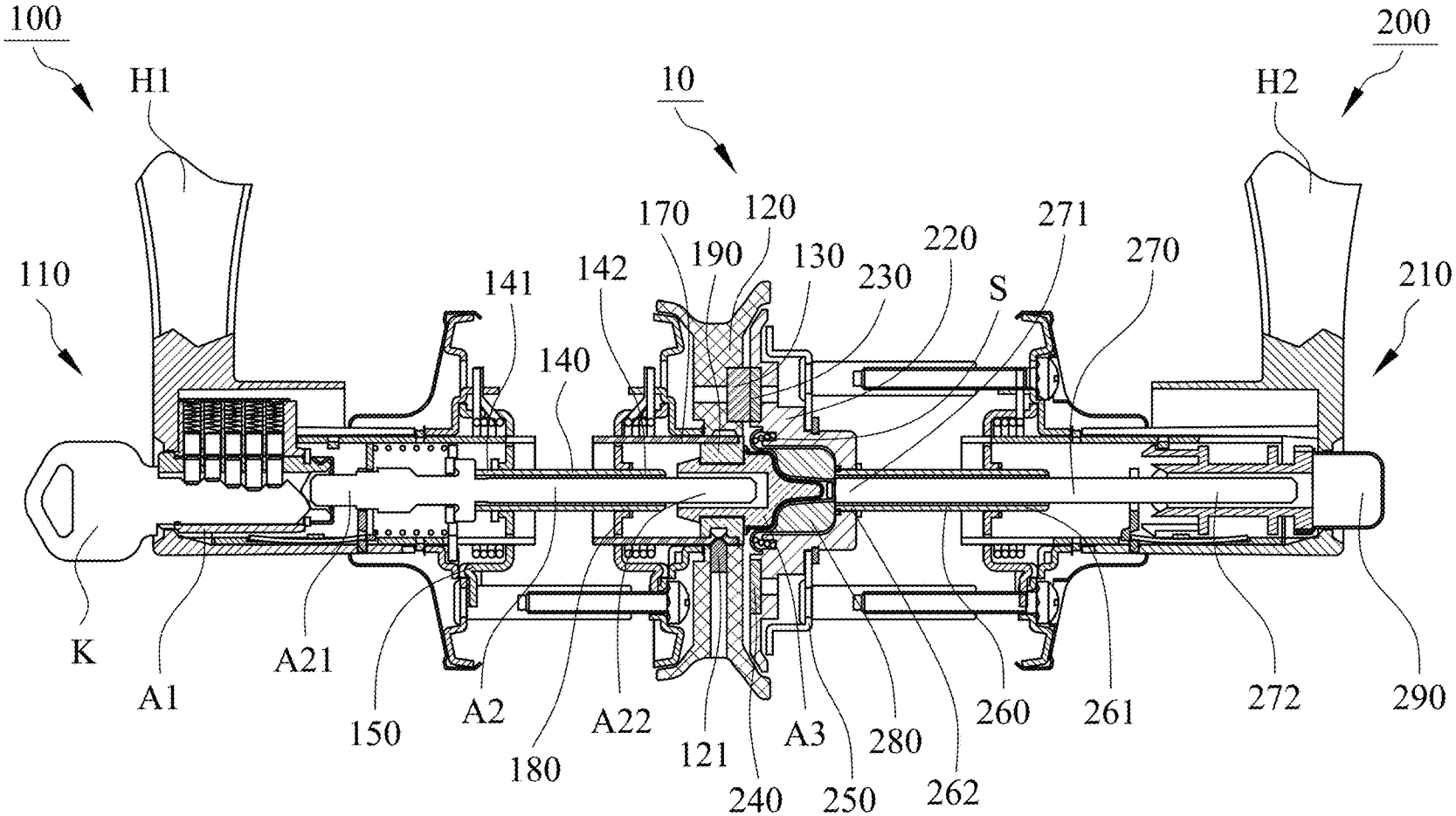
FIG. 10 is a cross-section view diagram illustrating the double-door lock assembly in accordance with one embodiment of the present invention.

With reference to FIGS. 2, 5, 6 and 9, the second handle group 210 is mounted on one side surface D21 of the second door D2, and the second rotation member 220 is rotatable mounted on other side surface D22 of the second door D2. With reference to FIG. 2, the side surface D22 of the second door D2 faces toward the side surface D12 of the first door D1. The second handle group 210 links to the second rotation member 220 for rotating the second rotation member 220. With reference to FIGS. 5, 9 and 10, the second linkage member 230 is arranged on the second rotation member 220, and can rotate with the second rotation member 220 when the second rotation member 220 is rotating.

Figure 4:
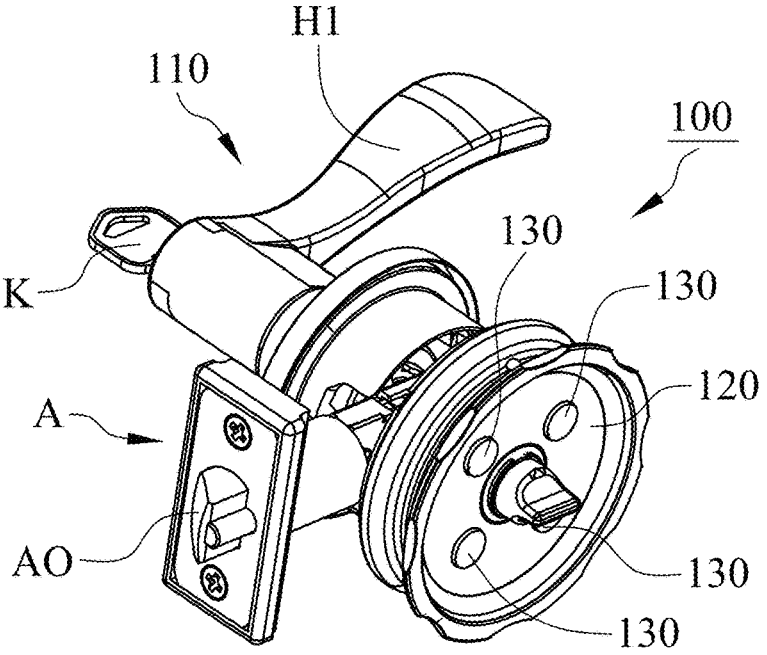
FIG. 4 is a perspective assembly diagram illustrating a first lock in accordance with one embodiment of the present invention.
Figure 7:
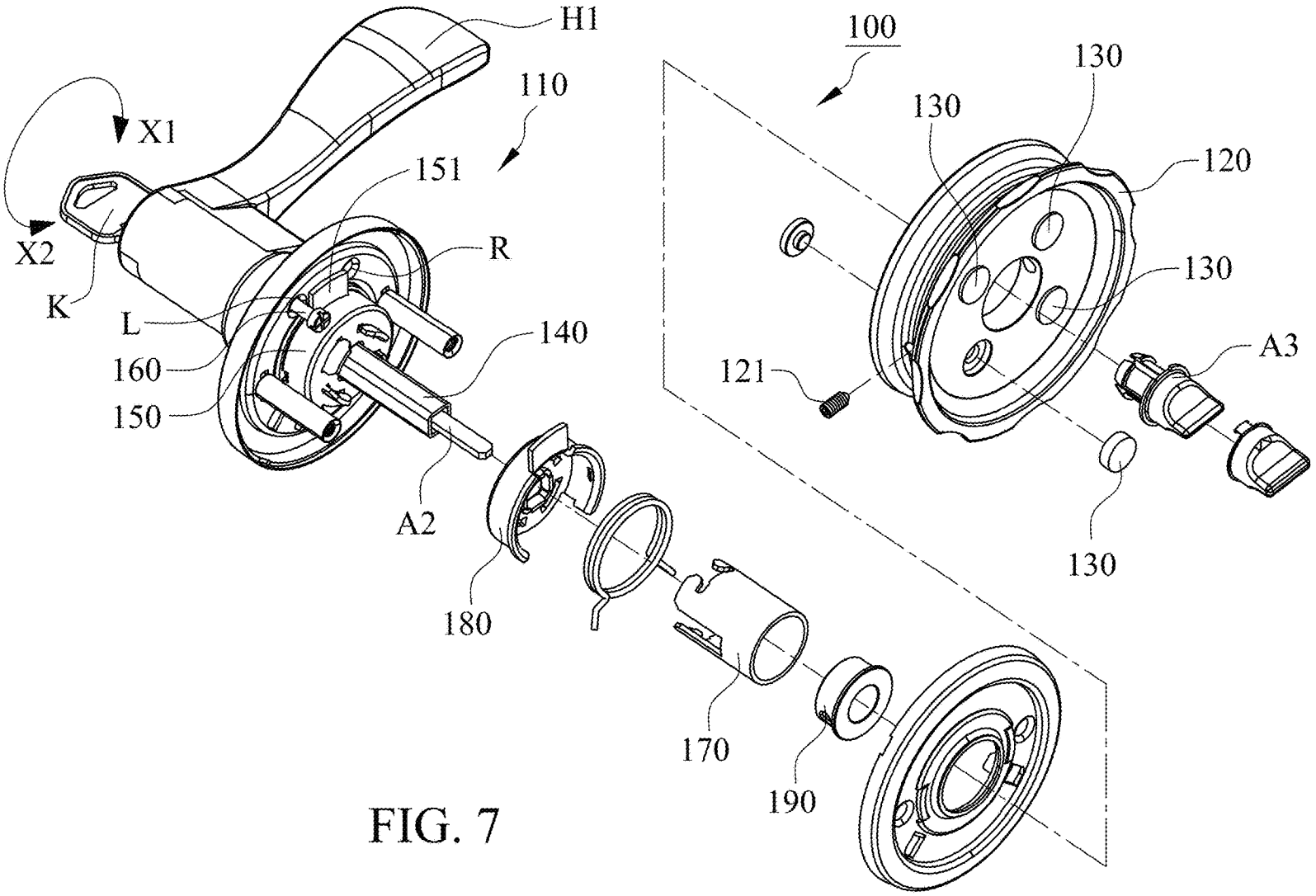
FIG. 7 is a perspective exploded diagram illustrating the first lock in accordance with one embodiment of the present invention.
Figure 8:
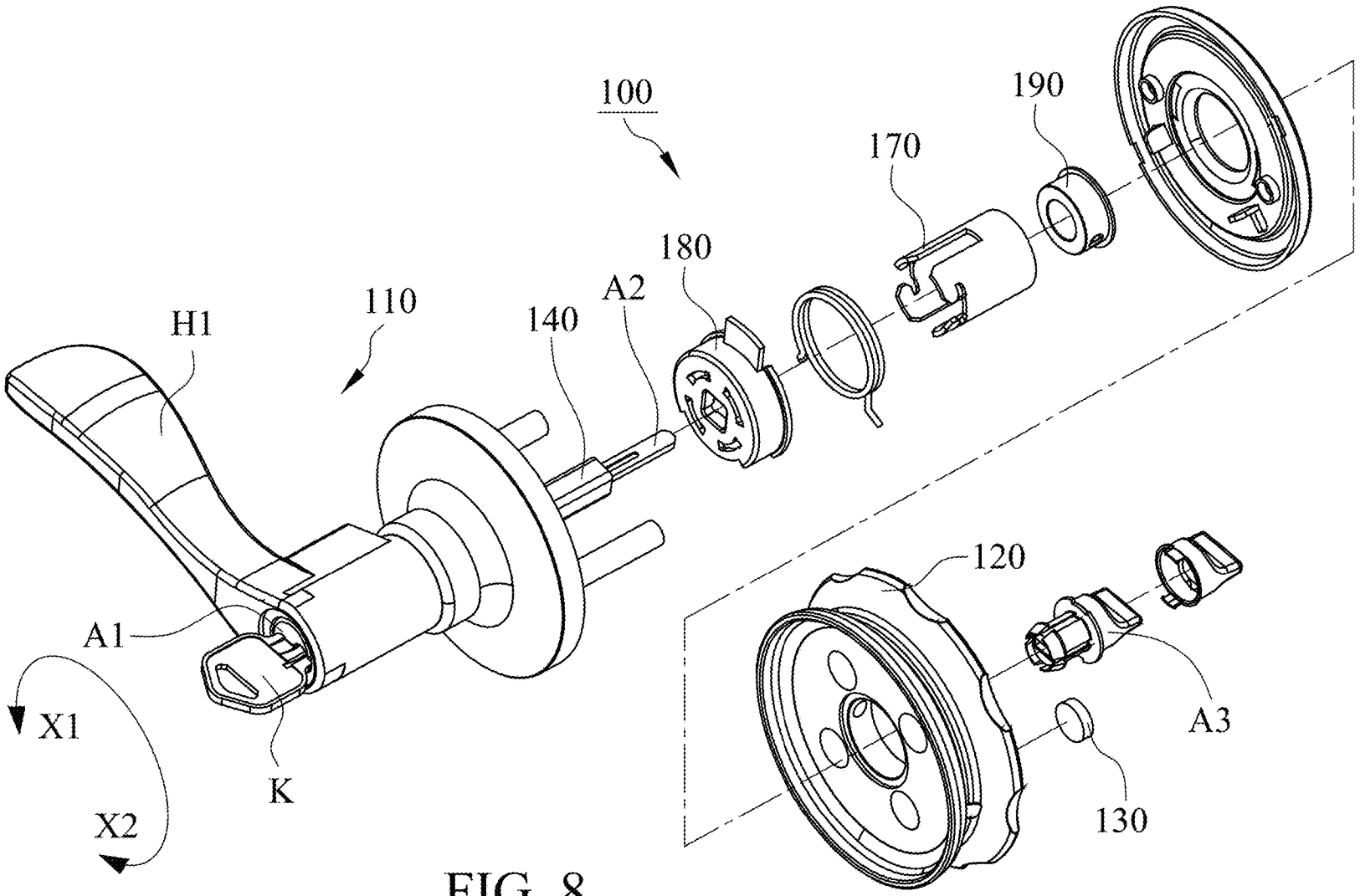
FIG. 8 is a perspective exploded diagram illustrating the first lock in accordance with one embodiment of the present invention.

With reference to FIGS. 4, 7 and 8, the first lock 100 further includes a first transmission tube 140, a shaft tube 170 and a transmission plate 180, wherein the first latch A is coupled with the first transmission tube 140, and the shaft tube 170 is coupled with the first rotation member 120 for simultaneous rotation. With reference to FIGS. 7, 8 and 10, the first lock 100 further includes a fixing member 121 in this embodiment of the present invention, wherein the fixing member 121, which is preferably a screw bolt, is capable of coupling the first rotation member 120 and the shaft tube 170 as one piece. Preferably, the first lock 100 further includes a supporting member 190 disposed in the shaft tube 170, and the fixing member 121 is adapted to connect the first rotation member 120, the shaft tube 170 and the supporting member 190 together as one piece.

With reference to FIGS. 4, 7, 8 and 10, the transmission plate 180 is coupled to and rotated with the shaft tube 170 as one piece. With reference to FIG. 10, a first end 141 and a second end 142 of the first transmission tube 140 are respectively connected to the first handle group 110 and the transmission plate 180 in this embodiment of the present invention. When pushing the first handle H1, it is capable of driving the first transmission tube 140, the transmission plate 180, the shaft tube 170 and the first rotation member 120 to rotate together. Inversely, when rotating the first rotation member 120, it can drive the shaft tube 170, the transmission plate 180, the first transmission tube 140 and the first handle H1 to rotate together. And the first transmission tube 140 in rotation enables to drive a latch bolt AO of the first latch A to move.

With reference to FIG. 7, the first lock 100 further includes a limiting plate 150 and a limiting member 160, wherein the limiting member 160 is arranged on the first handle group 110, and the limiting plate 150 is connected to the first transmission tube 140 for simultaneous rotation. The limiting member 160 is provided for limiting the limiting plate 150, so the limiting plate 150 and the first transmission tube 140 only can rotate in one direction only, and cannot rotate in the other direction. In this embodiment of the present invention, the limiting plate 150 includes a limiting portion 151, and the limiting member 160 is selectively disposed on one side of the limiting portion 151. For instance, the desired position of the limiting member 160 with respect to the limiting portion 151 is determined by the first lock 100 which is mounted on the left or right hand door. With reference to FIG. 7, the first handle group 110 includes a first coupling hole L and a second coupling hole R in this embodiment of the present invention. When the limiting member 160 is disposed on the first coupling hole L, the limiting plate 150 only can rotate in a first direction X1, and cannot rotate in a second direction X2 which is opposite to the first direction X1. And the first rotation member 120, same with the limiting plate 150, only can rotate in the first direction X1.

With reference to FIG. 7, on the other hand, the limiting plate 150 and the first rotation member 120 only can rotate in the second direction X2 when the limiting member 160 is disposed on the second coupling hole R, and they cannot rotate in the first direction X1. As a result, the first transmission tube 140, the transmission plate 180, the shaft tube 170 and the first rotation member 120 are restrained to rotate only in one of the first direction X1 and the second direction X2 because the limiting portion 151 is blocked by the limiting member 160.

With reference to FIGS. 5, 9 and 10, the second lock 200 further includes a second transmission tube 260 which is coupled with the second latch B. A first end 261 and a second end 262 of the second transmission tube 260 are respectively coupled to the second handle group 210 and the second rotation member 220. In this embodiment of the present invention, when pushing the second handle H2 down or up, it enables to rotate the second transmission tube 260 and the second rotation member 220. And the second transmission tube 260 in rotation enables to drive a latch bolt BO of the second latch B to operate.

With reference to FIGS. 5, 9 and 10, the second lock 200 further includes a base 250, wherein the base 250 is positioned on the second door D2, and the second rotation member 220 is rotatable disposed on the base 250. With reference to FIGS. 5 and 9, the second lock 200 further includes at least one pushing member 240 in this embodiment of the present invention. The pushing member 240 is disposed on the second rotation member 220 and located on one side of the second linkage member 230. With reference to FIG. 9, the second lock 200 includes a plurality of second linkage members 230 and pushing members 240 in this embodiment of the present invention, and the second linkage members 230 and the pushing members 240 are place alternately.

With reference to FIGS. 4 and 5, in this embodiment of the present invention, the first linkage members 130 and the second linkage members 230 are the magnetic components having different magnetisms, and the first linkage members 130 and the pushing members 240 are the magnetic components having the same magnetism. The magnetic components are preferably magnets or electromagnets.

With reference to FIGS. 3, 6, 10 and 11, the first linkage member 130 corresponds and connects to the second linkage member 230 when the first door D1 and the second door D2 are close with each other and the second linkage member 230 is located at a first position. In this embodiment of the present invention, the second linkage member 230 of the second lock 200 attracts the first linkage member 130 of the first lock 100 (shown as FIG. 11) to couple the first lock 100 and the second lock 200.

Figure 11:
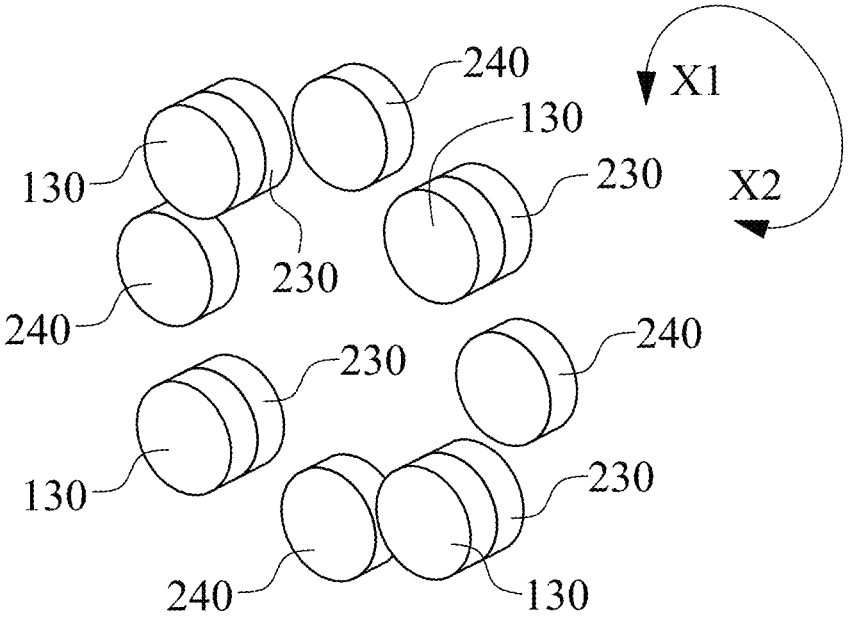
FIG. 11 is a perspective diagram illustrating second linkage members located at a first position in accordance with one embodiment of the present invention.

With reference to FIGS. 3, 6, 10 and 11, in this embodiment of the present invention, the second lock 200 is connected to the first lock 100 by the second linkage member 230 and the first linkage member 130 (shown as FIG. 11). When the second handle H2 is pushed down, it drives the second transmission tube 260 and the second rotation member 220 to rotate in the first direction X1, and allows the second transmission tube 260 to unlock the latch bolt BO of the second latch B. The first linkage member 130 is rotated following the rotation of the second linkage member 230 which is rotated in the first direction X1 with the second rotation member 220, so the first linkage member 130 in rotation allows the first rotation 120 to rotate in the first direction X1. And the first rotation member 120 in rotation allows the shaft tube 170, the transmission plate 180, the first transmission tube 140 and the limiting plate 150 to rotate in the first direction X1, and allows the first transmission tube 140 to unlock the latch both AO of the first latch A. For this reason, the first door D1 and the second door D2 can be opened or closed simultaneously in the same direction. Similarly, the first handle H1 enables to drive the first transmission tube 140 to rotate in the first direction X1 to unlock the first latch A when it is pushed down. And owing to the first linkage member 130 is rotated in the first direction X1 following the first rotation member 120, it drives the second linkage member 230 to allow the second rotation member 220 to rotate in the first direction X1. And the second rotation member 220 allows the second transmission tube 260 to rotate in the first direction X1 and unlock the latch bolt BO of the second latch B, so the first door D1 and the second door D2 are capable of opening or closing simultaneously in the same direction.

Figure 6:
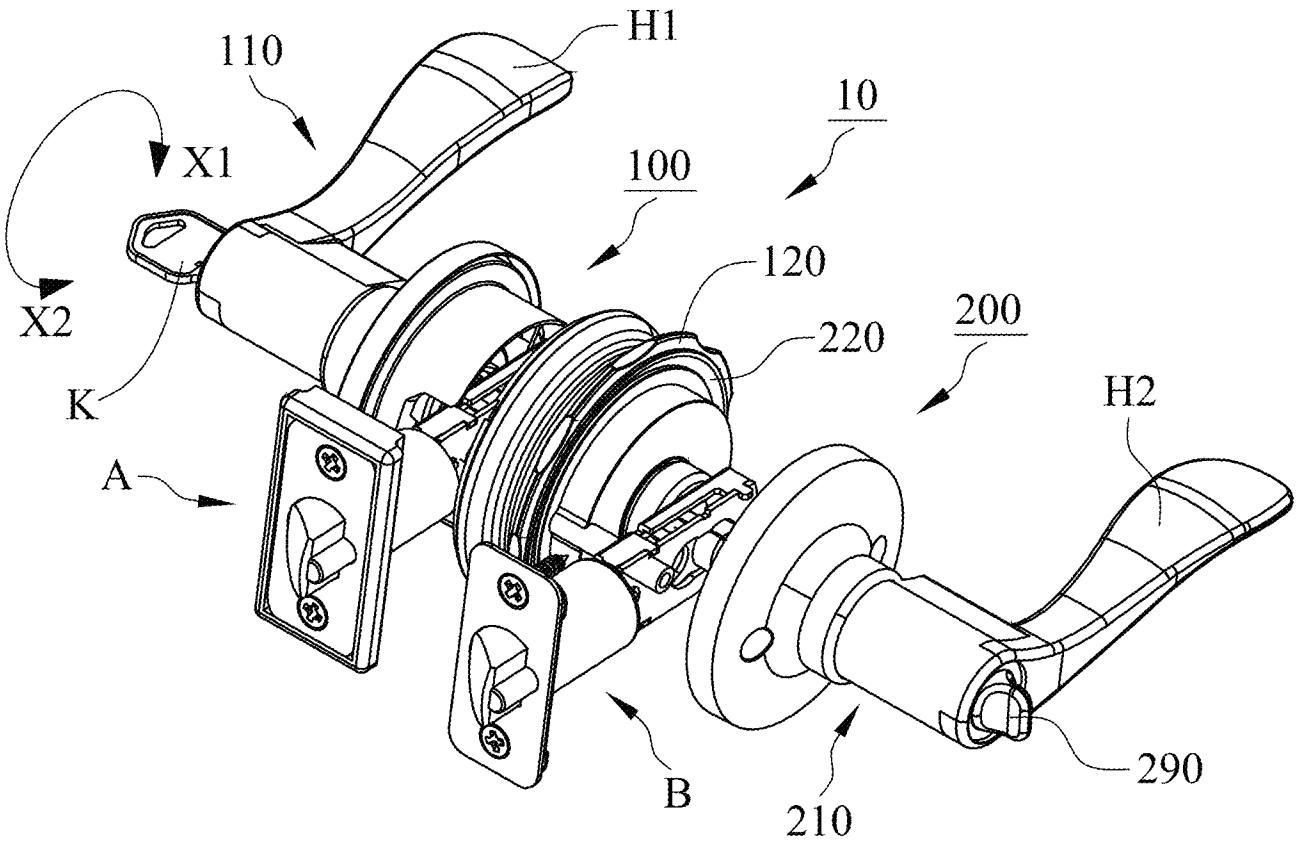
FIG. 6 is a perspective assembly diagram illustrating the double-door lock assembly in accordance with one embodiment of the present invention.
Figure 12:
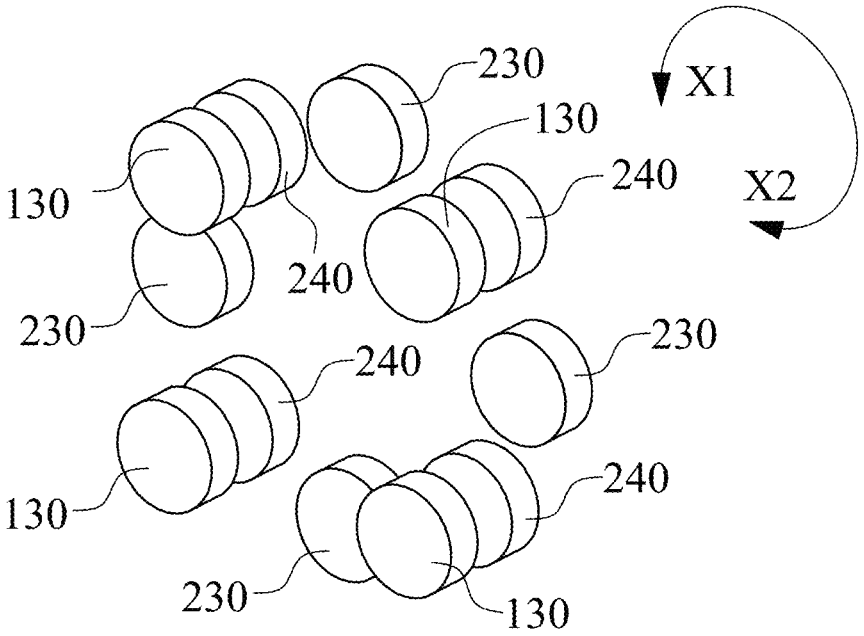
FIG. 12 is a perspective diagram illustrating the second linkage members located at a second position in accordance with one embodiment of the present invention.

With reference to FIG. 7, the limiting member 160 is disposed, but not limited to, on the first coupling hole L. With reference to FIGS. 6, 9 and 10, in order to separate apart the first lock 100 and the second lock 200 to respectively open or close the first door D1 and the second door D2, the second handle H2 is pushed up to allow the second transmission tube 260 and the second rotation member 220 to rotate in the second direction X2 which is opposite to the first direction X1, and the second linkage member 230 is also rotated in the second direction X2 with the second rotation member 220. With reference to FIGS. 7, 9 and 12, the first linkage member 130 cannot rotate in the second direction X2 with the second linkage member 230 owing to the limiting member 160 stops the rotation of the limiting plate 150 in the second direction X2. With reference to FIG. 12, while the second rotation member 220 continues to allow the second linkage member 230 to rotate in the second direction X2, the second linkage member 230 may misalign with and separate from the first linkage member 130 to locate at a second position, and then the pushing member 240 corresponds to the first linkage member 130. In this embodiment of the present invention, the first linkage member 130 repels the pushing member 240 to separate the first lock 100 and the second lock 200 because the first linkage member 130 and the pushing member 240 are the magnetic components having the same magnetism.

Figure 13:
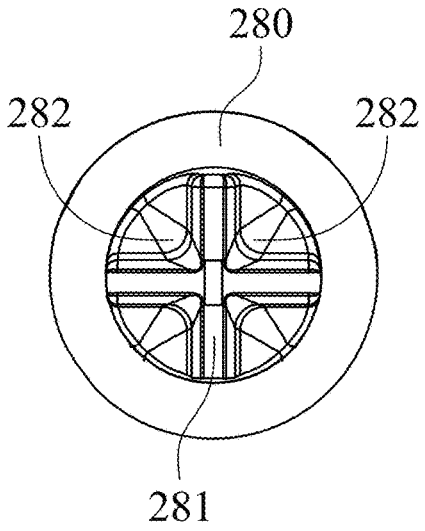
FIG. 13 is a lateral view diagram illustrating a knob base in accordance with one embodiment of the present invention.

With reference to FIGS. 6, 7, 8 and 10, the first lock 100 further includes a lock cylinder A1, a first transmission shaft A2 and a first knob A3 which are capable of rotating simultaneously, wherein a first end A21 and a second end A22 of the first transmission shaft A2 are respectively coupled to the lock cylinder A1 and the first knob A3. With reference to FIGS. 5, 9 and 10, the second lock 200 further includes a second transmission shaft 270, a knob base 280 and a second knob 290, wherein the knob base 280, which is adapted to accommodate the first knob A3, is rotatable disposed on the second rotation member 220. A first end 271 and a second end 272 of the second transmission shaft 270 are respectively coupled with the knob base 280 and the second knob 290, so the second transmission shaft 270, the knob base 280 and the second knob 290 can rotate together. With reference to FIG. 13, the knob base 280 includes a restriction groove 281 and at least one restriction rib 282 located in the restriction groove 281 in this embodiment of the present invention, wherein the restriction groove 281 is adapted to accommodate the first knob A3. With reference to FIGS. 9 and 10, the second lock 200 further includes an elastic member S which is located between the knob base 280 and the second rotation member 220. When the first knob A3 contacts against the restriction rib 282 in the restriction groove 281, the knob base 280 compresses the elastic member S to allow the first knob A3 to move into the restriction groove 281 along the restriction rib 282. The elastic member S is utilized to help the first knob A3 to accommodate in the restriction groove 281 easily, so the knob base 280 and the first knob A3 will not hit and damage each other.

With reference to FIG. 10, the first lock 100 enables to connect to the second lock 200 through the first linkage member 130 and the second linkage member 230, and the first knob A3 is placed in the restriction groove 281 of the knob base 280, so the second knob 290 can rotate the second transmission shaft 270 and the knob base 280 when it is rotating, and the knob base 280 can simultaneously rotate the first knob A3 and the first transmission shaft A2 by the restriction rib 282 to unlock the lock cylinder A1. As a result, the first door D1 and the second door D2 can be simultaneously opened or closed in the same direction by the first handle H1 or the second handle H2. In the same way, rotating a key K inserted in the lock cylinder A1 to rotate the first transmission shaft A2 and the first knob A3 also can push the first handle H1 or the second handle H2 to simultaneously open or close the first door D1 and the second door D2 in the same direction.

Figure 14:
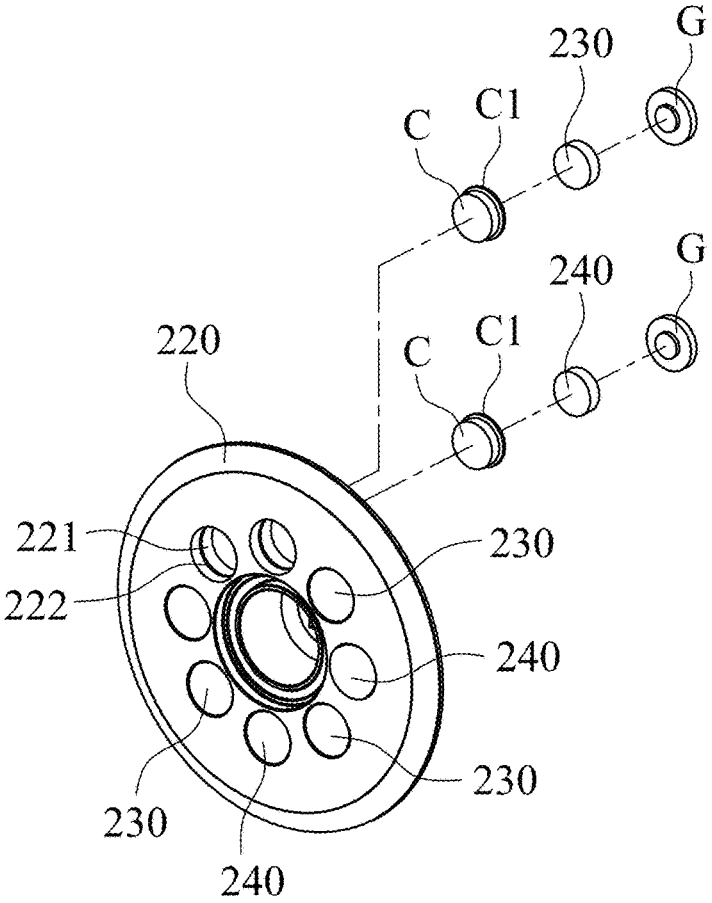
FIG. 14 is a perspective exploded diagram illustrating a second rotation member, the second linkage members, covers and blocking members in accordance with one embodiment of the present invention.
Figure 15:
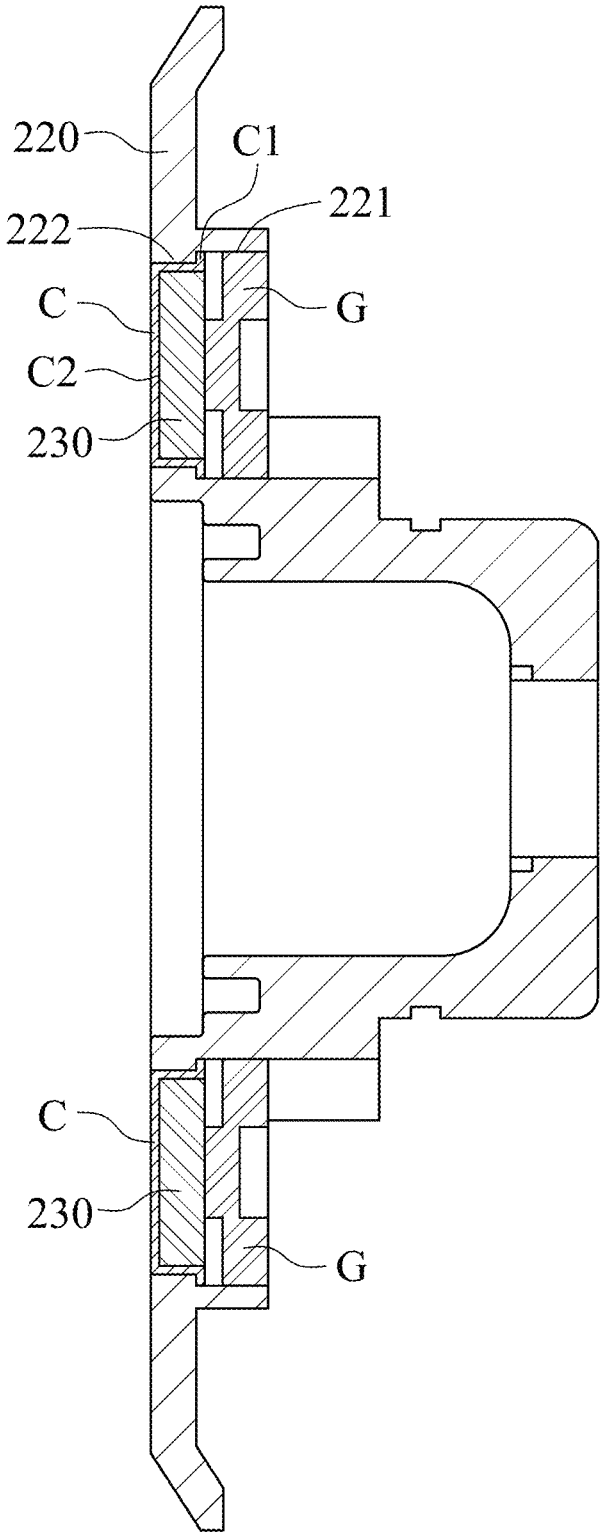
FIG. 15 is a cross-section view diagram illustrating the second rotation member, the second linkage members, the covers and the blocking members in accordance with one embodiment of the present invention.

With reference to FIGS. 14 and 15, the second rotation member 220 includes at least one accommodation hole 221 in another embodiment of the present invention, and the second linkage member 230 is disposed in the accommodation hole 221. Preferably, the second lock 200 includes at least one cover C, wherein the cover C is adapted to cover the second linkage member 230 to prevent the second linkage member 230 from separating from the second rotation member 220, and prevent the second linkage member 230 from colliding with the first linkage member 130. Additionally, the cover C can prevent rust of the second linkage member 230 if the second linkage member 230 is a magnet.

With reference to FIG. 15, the cover C is placed in the accommodation hole 221 and includes a blocking portion C1 and an accommodation space C2 in this embodiment, and there is a blocking flange 222 in the accommodation hole 221. The second linkage member 230 is located in the accommodation space C2, and the blocking portion C1 is blocked by the blocking flange 222 to prevent the second linkage member 230 from falling from the accommodation hole 221 of the second rotation member 220. The second lock 200 preferably includes a plurality of blocking members G, wherein each of the blocking members G is disposed in the accommodation hole 221, and the second linkage member 230 is restricted between the blocking member G and the cover C to avoid the falling of the second linkage member 230 from the second rotation member 220. In this embodiment of the present invention, the pushing member 240, like the second linkage member 230, is placed in a cover C and limited between the cover C and a blocking member G.

Figure 16:
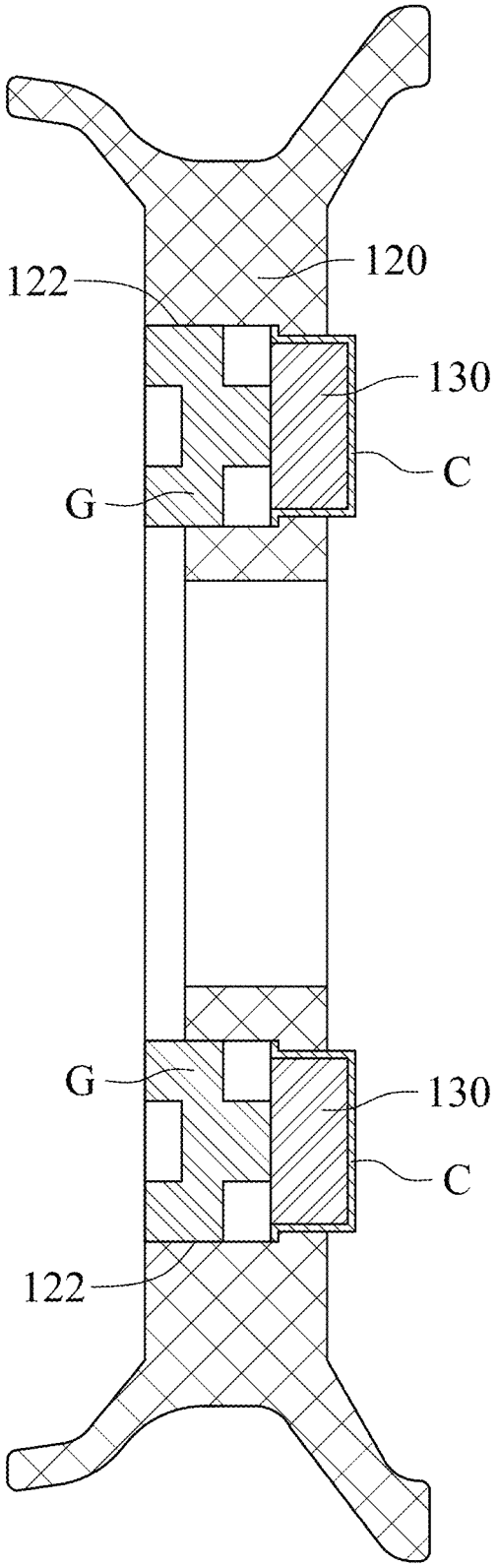
FIG. 16 is a cross-section view diagram illustrating a first rotation member, first linkage members, covers and blocking members in accordance with one embodiment of the present invention.

With reference to FIG. 16, the first lock 100, same with the second lock 200, includes at least one cover C in this embodiment, and the first rotation member 120 includes at least one accommodation space 122. The cover C is placed in the accommodation space 122, and the first linkage member 130 is disposed in the cover C and restrained between the cover C and a blocking member G to prevent the first linkage member 130 from separating from the first rotation member 120.

While this invention has been particularly illustrated and described in detail with respect to the preferred embodiments thereof, it will be clearly understood by those skilled in the art that is not limited to the specific features shown and described and various modified and changed in form and details may be made without departing from the spirit and scope of this invention.

What is claimed is:

1. A double-door lock assembly which is mounted on a first door and a second door comprising:

a first lock mounted on the first door, wherein the first lock includes a first handle group, a first rotation member, and at least one first linkage member, the first handle group is coupled to the first rotation member for rotating the first rotation member, and the at least one first linkage member is disposed on and rotated with the first rotation member and a second lock mounted on the second door, wherein the second lock includes a second handle group, a second rotation member, and at least one second linkage member, the second handle group is coupled to the second rotation member for rotating the second rotation member, the at least one second linkage member is disposed on and rotated with the second rotation member and wherein, when the at least one second linkage member is located at a first position, the at least one first linkage member corresponds and connects to the at least one second linkage member for simultaneous rotation of the first and second rotation members and, when the at least one second linkage member is located at a second position, the at least one first linkage member misaligns with and disconnects from the at least one second linkage member to separate the first and second locks.

2. The double-door lock assembly in accordance with claim 1, wherein the first lock further includes a first transmission tube, a limiting plate and a limiting member, the limiting member is positioned on the first lock, a first end of the first transmission tube is coupled to the first handle group, and the limiting plate is coupled to the first transmission tube, wherein when the first rotation member is driven by the second rotation member to rotate in a first direction, the first transmission tube and the limiting plate are rotated in the first direction with the first rotation member, and wherein when the second rotation member drives the first rotation member to rotate in a second direction which is opposite to the first direction, the limiting member blocks the limiting plate to cause the first transmission tube and the first rotation member to be unable to rotate in the second direction, and cause the at least one second linkage member to misalign with and separate from the at least one first linkage member.

3. The double-door lock assembly in accordance with claim 2, wherein the first lock further includes a shaft tube which is coupled to the first rotation member and is simultaneously rotated with the first rotation member.

4. The double-door lock assembly in accordance with claim 3, wherein the first lock further includes a fixing member which is utilized to couple the first rotation member and the shaft tube.

5. The double-door lock assembly in accordance with claim 4, wherein the first lock further includes a supporting member disposed in the shaft tube, and the fixing member is utilized to couple the first rotation member, the shaft tube and the supporting member.

6. The double-door lock assembly in accordance with claim 3, wherein the first lock further includes a transmission plate coupled with the shaft tube, and the transmission plate is rotated with the shaft tube simultaneously, wherein a second end of the first transmission tube is coupled to the transmission plate.

7. The double-door lock assembly in accordance with claim 1, wherein the second lock further includes at least one pushing member disposed on the second rotation member and wherein, when the at least one second linkage member is located at the second position, the at least one pushing member corresponds to and disconnects from the at least one first linkage member to separate the second lock from the first lock.

8. The double-door lock assembly in accordance with claim 7, wherein the first lock includes a plurality of first linkage members, the second lock includes a plurality of second linkage members and pushing members, and the second linkage members and the pushing members are placed alternately.

9. The double-door lock assembly in accordance with claim 1, wherein the second lock further includes a base which is positioned on the second door, and the second rotation member is rotatably disposed on the base.

10. The double-door lock assembly in accordance with claim 1, wherein the second lock further includes a second transmission tube, and a first end and a second end of the second transmission tube are respectively coupled to the second handle group and the second rotation member.

11. The double-door lock assembly in accordance with claim 1, wherein the first lock further includes a lock cylinder, a first transmission shaft and a first knob, and a first end and a second end of the first transmission shaft are respectively coupled to the lock cylinder and the first knob, wherein the second lock further includes a second transmission shaft, a knob base and a second knob, and a first end and a second end of the second transmission shaft are respectively coupled to the knob base and the second knob, and wherein the first knob is accommodated in the knob base when the at least one second linkage member is located at the first position.

12. The double-door lock assembly in accordance with claim 11, wherein the second lock further includes an elastic member which is located between the knob base and the second rotation member, and the knob base is rotatably disposed on the second rotation member.

13. The double-door lock assembly in accordance with claim 11, wherein the knob base includes a restriction groove and at least one restriction rib located in the restriction groove, and the restriction groove is provided for accommodating the first knob.

14. The double-door lock assembly in accordance with claim 1, wherein the at least one first linkage member and the at least one second linkage member are magnetic components having different magnetisms.

15. The double-door lock assembly in accordance with claim 7, wherein the first at least one linkage member and the at least one pushing member are magnetic components having the same magnetism.

16. The double-door lock assembly in accordance with claim 14, wherein the magnetic components are magnets or electromagnets.

17. The double-door lock assembly in accordance with claim 15, wherein the magnetic components are magnets or electromagnets.

18. The double-door lock assembly in accordance with claim 1, wherein the first at least one linkage member is disposed in a cover and is restricted between the cover and a blocking member.

19. The double-door lock assembly in accordance with claim 1, wherein the at least one second linkage member is disposed in a cover and is restricted between the cover and a blocking member.

20. The double-door lock assembly in accordance with claim 7, wherein the at least one pushing member is disposed in a cover and is restricted between the cover and a blocking member.

* * * * *